US005357992A

United States Patent [19]

Yang

[11] Patent Number: 5,357,992

[45] Date of Patent: Oct. 25, 1994

[54] HEAT CYCLE TYPE DISHWASHER

[76] Inventor: Shui-Chuang Yang, No. 29, Min-Tsu Road, Hsueh Chia Jenn, Tainan Hsien, Taiwan

[21] Appl. No.: 82,221

[22] Filed: Jun. 24, 1993

[51] Int. Cl.[5] ..... B08B 3/02

[52] U.S. Cl. ..... 134/107; 134/200; 134/111

[58] Field of Search ..... 134/107, 200, 56 D, 134/57 D, 58 D, 95.1, 99.1, 111

[56] References Cited

U.S. PATENT DOCUMENTS

| | | | |
|---|---|---|---|
| 1,528,069 | 3/1925 | Merseles | 134/99.1 |
| 1,559,727 | 11/1925 | Merseles et al. | 134/107 |
| 1,662,496 | 3/1928 | Forsgard | 134/99.1 |
| 2,254,269 | 9/1941 | Clark et al. | 134/107 X |
| 2,281,852 | 5/1942 | Messler | 134/95.1 |
| 2,370,609 | 2/1945 | Wilson et al. | 134/99.1 |
| 2,490,634 | 12/1949 | Keene | 134/99.1 |
| 2,706,990 | 4/1955 | Lyman | 134/95.1 |
| 3,949,772 | 4/1976 | Hartmann | 134/99.1 |
| 4,217,924 | 8/1980 | Finger | 134/107 |

*Primary Examiner*—Frankie L. Stinson
*Attorney, Agent, or Firm*—Pro-Techtor International

[57] ABSTRACT

A heat cycle type dishwasher having a housing body for the preformance of washing and cleaning processes therein, and water supplied from the main water reservoir is heated by the burner cap and distributed to the washing tub and the cleaning tub. For washing and cleaning, at first water in the main water reservoir is delivered to the upper and lower manifolds by means of the pump, for washing the dishes with the pressurized water column and detergent, and the used water is filtered and returned to the washing tub for cycle use, which is the cycle type washing process. And next clean water in the cleaning tub is delivered to the cleaning manifolds by means of the pump for the performance of cleaning process. The two processes are performed alternatively to accomplish washing and cleaning of dishes.

3 Claims, 5 Drawing Sheets

HEAT CYCLE TYPE DISHWASHER

FIELD OF THE INVENTION

This invention relates to a water-saving and efficient dishwasher, and particularly to a heat cycle type dishwasher that can accomplish full result of washing clean by means of cycle type alternative washing and cleaning with hot water throughout the washing process.

BACKGROUND OF THE INVENTION

Most of the conventional dishwashers are engaged in washing with cool water or in company with hot water introduced additionally, or with cool water and hot water alternatively by means of heating with an electric heater while almost all of them have low flow pressure. They are suitable to such occasions as a small family or for cleaning cups and other utensils which are not oily. Notwithstanding, for a hospital, hotel or restaurant, etc., where there are a large number of oily dishes, residuals and food remainings having resulted in a big problem of cleanup and disposal for the food serving industry.

Further most of the conventional dishwashers are designed with direct drain after washing up to cause a huge waste of water. Providing the wastewater is not treated it will result in a great damage to the water resource because of lowering oxygen content to evoke another environmental protection problem. It is significant that an improvement for the conventional dishwashers is necessary for ensuring a reliable way of washing clean dishes and untensils as well as the prevention of water resource waste.

In view of aforesaid defects found in the conventional dishwashers, the inventor therefore has devoted to research based on related experience to the design and manufacture of such item, and has developed the invention after persistent testings and improvements.

SUMMARY OF THE INVENTION

One object of the invention is to provide a heat cycle type dishwasher which is effective to wash up extremely oily dishes and food utensils in an easy manner by using hot water entirely.

Another object of the invention is to provide a heat cycle type dishwasher to economize water consumption by means of cycle washing.

Still another object of the invention is to provide a heat cycle type dishwasher which can accomplish a full result of cleaning up by means of alternative washing and cleaning water.

These and other objects and advantages of the present invention will become apparent to those skilled in the art after considering the following detailed specification together with the accompanying drawings.

DETAILED DESCRIPTION OF THE PREFERRED EMBODIMENT

Figure 1:
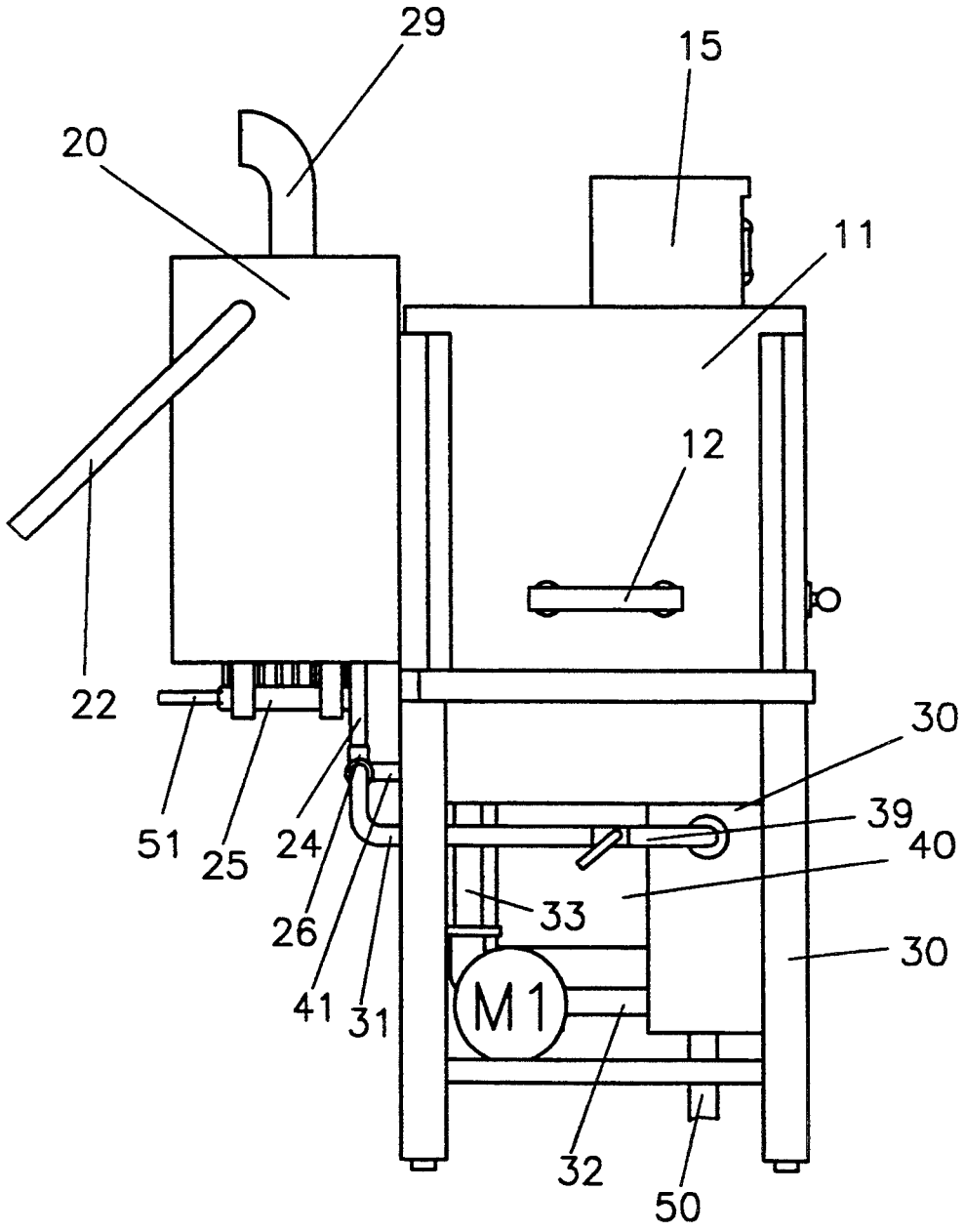
FIG. 1 is a front view showing the appearance of the invention and the relationship among the main water reservoir, burner cap and washing tub.

Referring to the drawings, the heat cycle type dishwasher comprises a housing body 10, a main water reservoir 20, a washing tub 30, a cleaning tub 40, upper and lower spray mainfolds 35, 34, a cleaning mainfold 44, a washing pump M1, a cleaning pump M2, a burner cap 25 and a proper number of pipelines.

Figure 5:
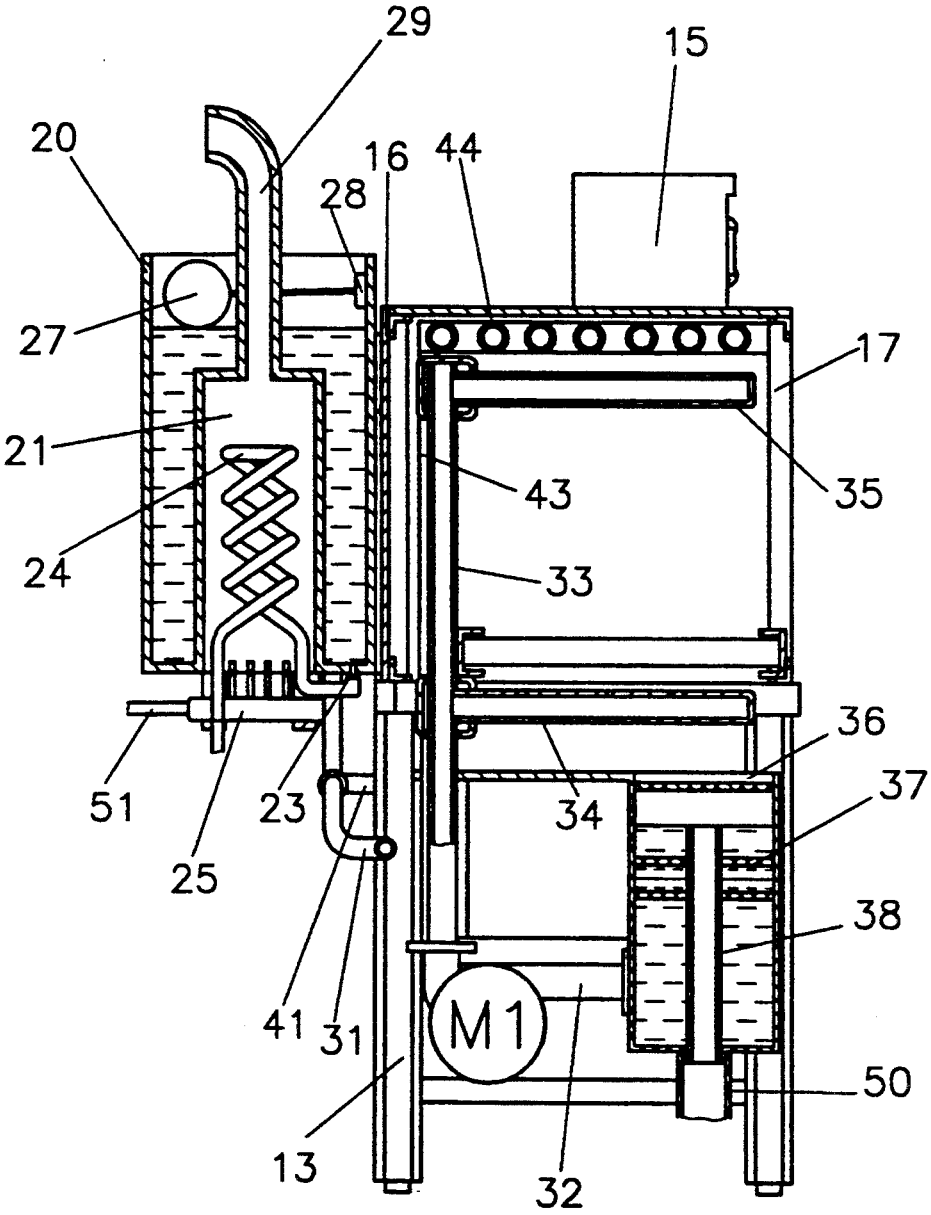
FIG. 5 is a perspective front view of the invention, showing the relationship among the internal members with exception to the screw tube within the main water reservoir, the burner cap located beneath and the pump.

Referring to FIGS. 1 and 5, the bottom end of the housing body 10 resembles a rectangular tub body, and one side is extending upward to form a wall 16, and two corners of corresponding side have a strut 17 respectively. The top of the wall 16 and each strut 17 is connected with a crown plate 18 which has a control switch box 15 for accomodating a power switch and distribution board. Except for the side forming a wall 16, the other three sides of portion from the crown plate to the bottom end of the rectangular tub body have a movable door allowing to open/close by lifting up/-down. And each door has a handle 12. Each of three inner sides of the crown plate 18 has a hanger 14. When the door 11 is lifted up to open the hanger 14 can be provided to support the door 11. A stand 13 is mounted under the housing body 10 for elevating the housing body 10 up to an appropriated height for working in facility as well as for fixing other important members.

Figure 3:
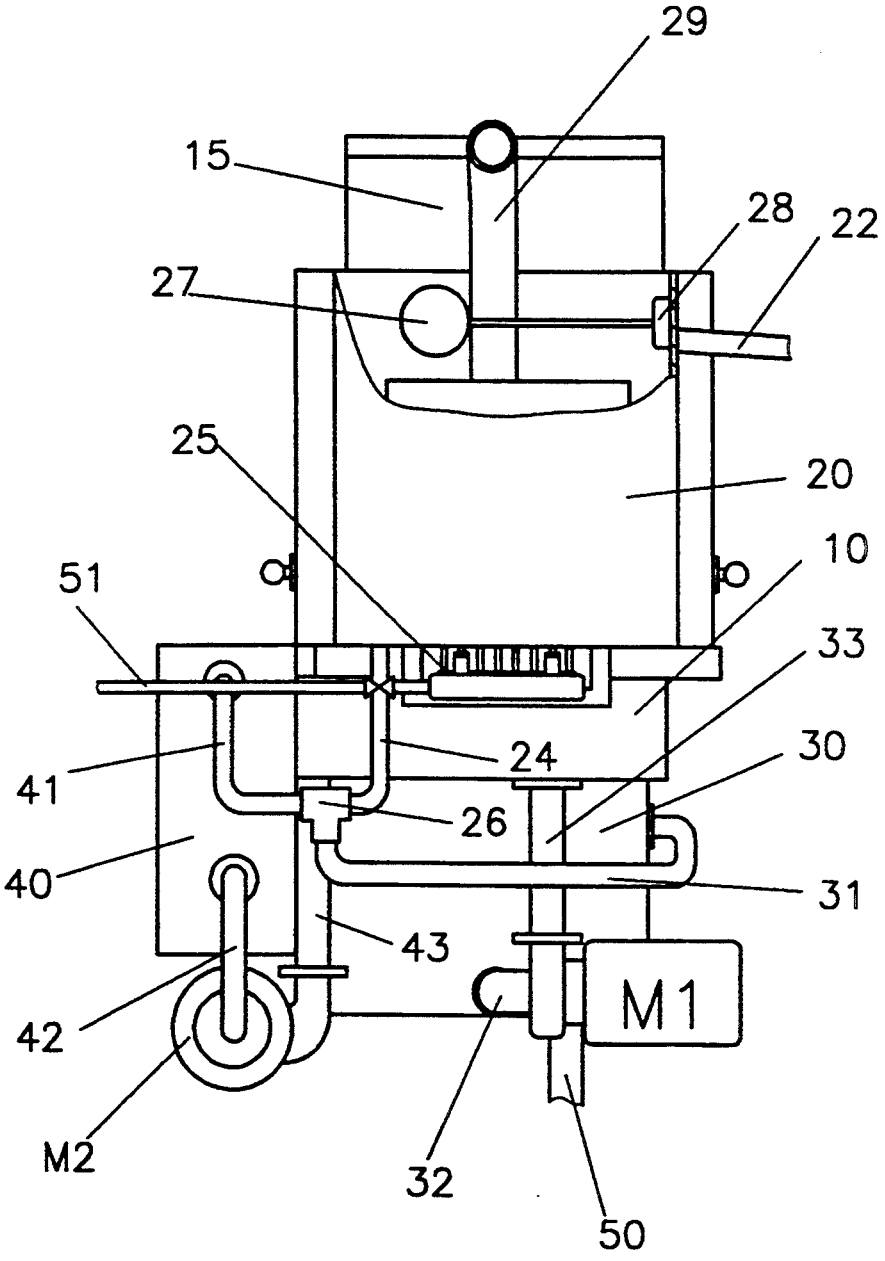
FIG. 3 is left-sided view showing the invention is removed with the stand and showing the arrangement of the main water reservoir, burner cap, two pumps and each pipeline.

The main water reservoir 20 as shown is secured to the external side of the wall plate 16, resembling a cylindrical container, and its bottom is projecting to resemble a cap type accomodation 21, and its top end is extending with an exhaust pipe 29. Referring to FIG. 3, the main water reservoir 20 accomodates a level control switch 28—a float 27 is used as level sensor according to the embodiment and certainly other type such as electrical, electronic components may be used to accomplish the same function. The inner structure of the main water reservoir as shown in FIG. 5, the bottom end has a drain hole 23 for connecting a screw tube 24 which is received in the accomodation 21 to form a chamber, and screwing up first and then screwing down to resemble a compression spring while both the inlet and outlet ends are located in the lower side wherein the outlet end has a T joint 26.

Referring to FIG. 5, a burner cap 25 is located right under the accomodation 21, including some burner cores extending upward for heating the water passing by the screw tube 24 and radial heats are available for preheating the water within the main water reservoir 20. The exhaust pipe 29 on the top end of the accomodation 21 can help promote air circulation so as to increase combustion efficiency as well as allow the gas such as $CO_2$ to escape therefrom.

Figure 2:
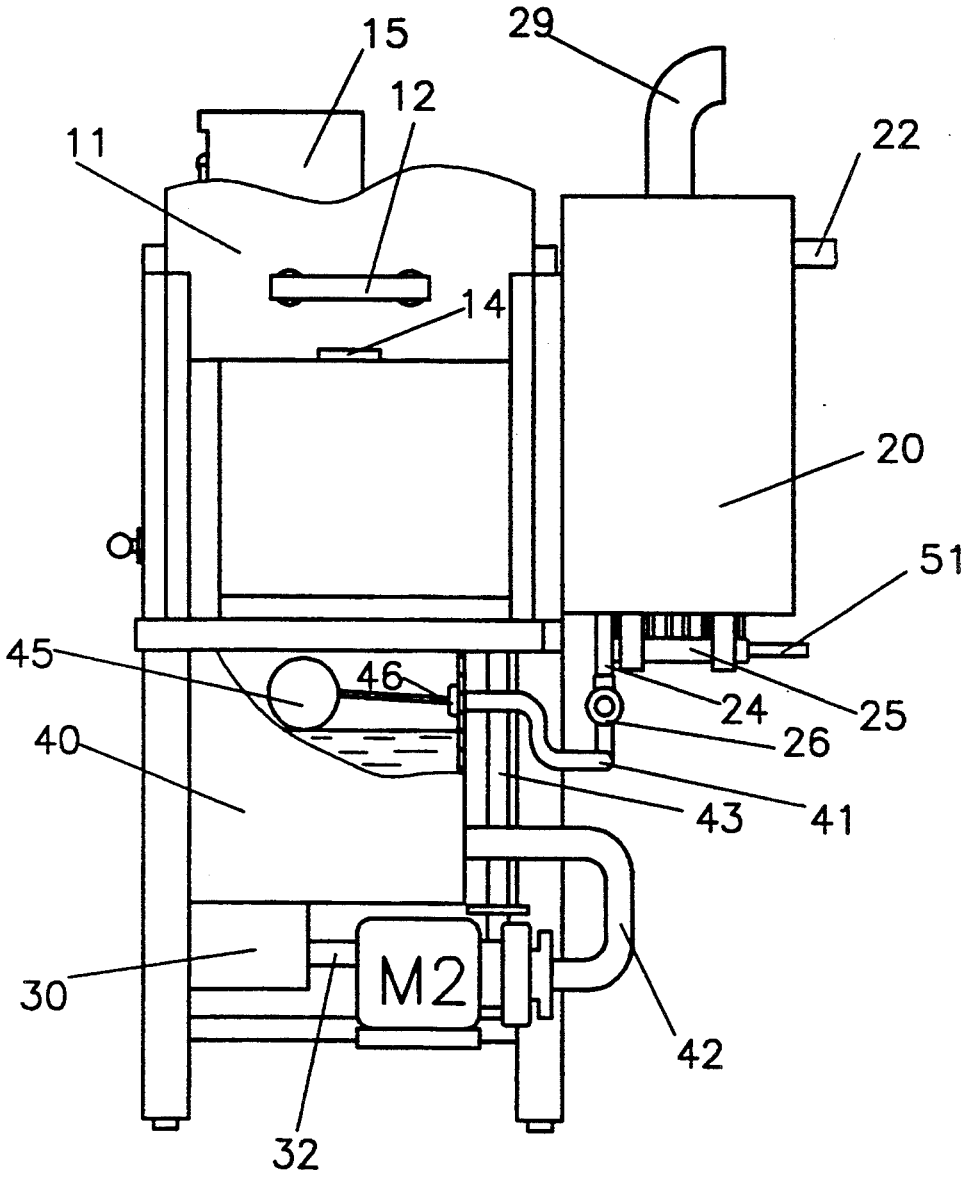
FIG. 2 is a rear view showing the relationship among the cleaning tub, cleaning pump and main water reservoir.

Referring to FIGS. 2 and 3, the external side of the stand 13 has a cleaning tub 40 that accomodates a float 44 and level switch 45 for controlling the water storage level, and just like the member for the main water reservoir it can be replaced in other type. The end of the intakepipe 41 connects a level switch 45 for controlling water feed and the other end connects a T-joint 26 for receiving hot water flow from the screw tube 24. A water feed pipe 42 is mounted under the cleaning tub 40 for connecting the inlet of the cleaning pump M2.

Figure 4:
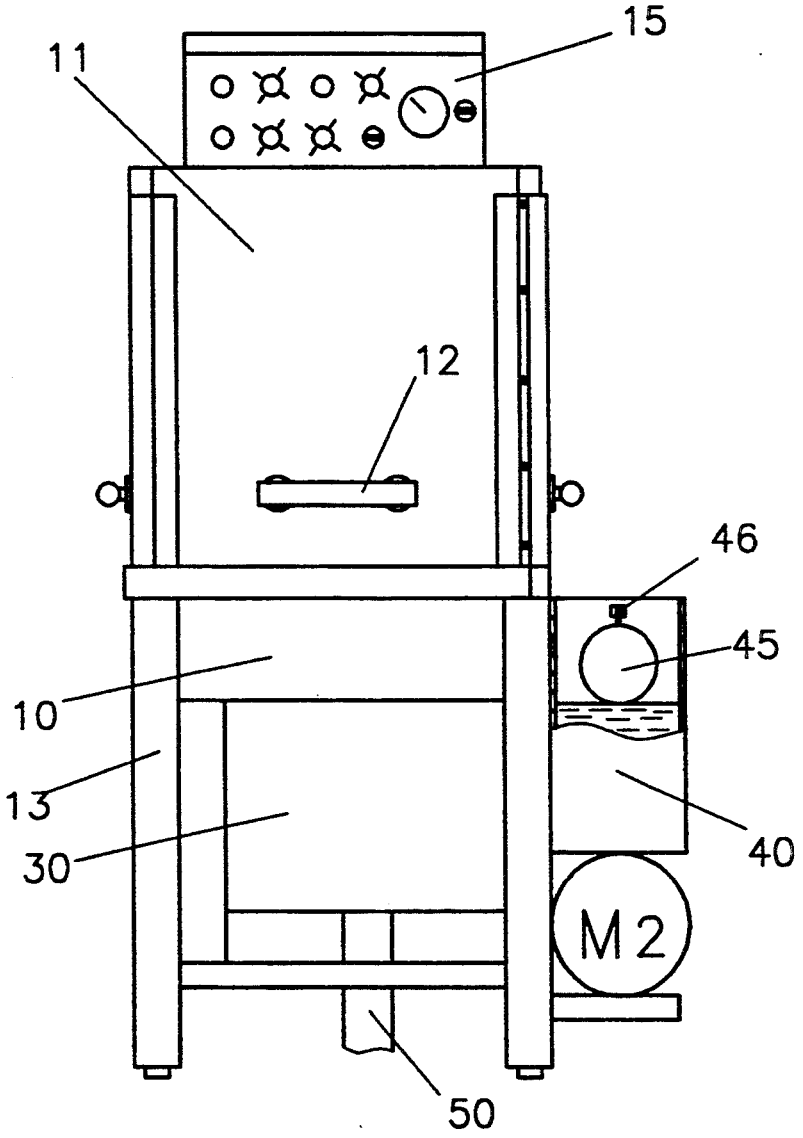
FIG. 4 is a right-sided view showing the arrangement of control panel, washing tub and cleaning tub.

Referring to FIGS. 1 and 4, the washing tub 30 is connected to the bottom of the housing body 10 and its top end is communicated with interior of the housing body 10 as shown in FIG. 5. The washing tub 30 is connected with T-joint 26 by means of the intake pipe 31 for introducing hot water flow from the screw tube 24 and the intake pipe 31 has a switch valve 52. The bottom of the washing tub 30 has an outlet pipe 38 extending upward to allow the excessive water over the outlet piple 38 to be discharged into the drain pipe 50. The side wall near the bottom of the washing tub 30 has a water feed pipe 32 for connecting the the inlet of the washing pump Mi. To prevent residuals and food remainings from entering the washing tub 30 or washing pump M1, filter nets 36, 37 are respectively mounted on the top of the outlet pipe 38 and between the top end of the outlet pipe 38 with the water feed pipe 32.

Referring to FIG. 5, the water supply pipe 33 is extending upward from the outlet of the washing pump M1 into the housing body 10, and the bottom of the housing body 10 has horizontally-distributed lower spray mainfolds 43, and the lower side of the crown plate 18 has horizontally-distributed upper spray mainfolds 34 at the end of the water supply pipe 33. Each of upper and lower manifolds 35, 34 has some nozzles wherein the nozzles of the upper spray manifolds 35 are spraying water down while those of the lower spray manifolds 34 are spraying water upward.

Referring to FIG. 2, the bottom end of the water supply pipe 43 is connected to the outlet of the cleaning pump M2 and extending upward into the housing body 10, and lower side of its top end (i.e. under the crown plate 18 and above the the upper spray manifolds 35) has horizontally-expanded cleaning mainfolds 44. The cleaning manifolds 44 have some spray-down nozzles and each of the nozzles will not be blocked by the upper spray manifolds 35 during cleaning flush.

For the use of the invention, at first place dishes row by row on the rack and put the rack into the housing body 10, close the door 11 and feed water into the main water reservoir 20 by means of the intake pipe 22. When water level is higher than the preset level on the level switch 28, the intake pipe 22 shall stop intaking. When water is fed by means of the intake pipe 22 fuel gas is fed into the burner cap 25 by means of gas pipe 51. When the burner cap 25 is ignited combustion begins to heat the water flowing by the screw tube 24 as well as to preheat the water within the main water reservoir 20. Referring to FIG. 3, hot water in the screw tube 24 continues to flow toward the T-joint 26 and respectively through the intake pipe 31 and intake pipe 41 entering the washing tub 30 and cleaning tub 40. When hot water flowing into the cleaning tub 40 is excessive over the preset level on the level switch 46, the intake pipe 31 is forced to stop water suction. Because the switch valve 39 is open from the beginning, hot water in the intake pipe 31 allows to flow into the washing tub 30 smoothly and at the moment necessary detergent can be dispensed simultaneously. When hot water is excessive over the top end of the outlet pipe 38 it will be discharged by means of the drain pipe 50. And the timer switch on the control switch box 15 can be set with cleaning time.

After time setting the washing pump M1 will be started automatically to suck in water from the water feed pipe 32 and to supply water through the water supply pipe 33. Hot water continues to rise for spraying against the dishes in a form of pressurized water column by means of the nozzles on the upper and lower spray manifolds 35, 34. When water cycle condition gets steady, the switch valve 39 can be closed and hot water will be stopped feeding into the washing tub 30. The used water will return to the washing tub 30 through the bottom of the housing body 10 after residuals and food remainings have been removed by means of filter nets 36, 37, for cycle use. Because the intake pipe 31 and intake pipe 41 have stopped feeding water, the water in the screw tube 24 also stops flowing and heating is not necessary any more at the moment so that the burner cap 25 may just keep a cap fire by reducing fuel gas consumption under the regulation by means of a control device or other similar control component.

When cycle washing has been carried on for some time, the washing pump M1 will stop running while the cleaning pump M2 will start running alternatively to carry out cleaning process. The water in the cleaning tub 40 will be sucked in by the cleaning pump M2 by means of the water suction pipe 42 to result in a sharp drop of level and the level switch 46 will open as soon as the float 45 is discovered dropping to allow water replenishment by means of the intake pipe 41. And water in the screw tube 24 will become flowing again and fuel gas supply is also increasing whereby water in the screw tube 24 will be heated. With the function of the cleaning pump M2, hot water will be pumped into the cleaning manifolds 44 by means of the water supply pipe 43 for cleaning and removing residual detergent attached to the dishes. During the process, the used water will be converged into the washing tub 30. When water is excessive over the level it will be discharged into the drain pipe 50 by means of the outlet pipe 38. All the water used is pure hot water supplied by the cleaning tub 40 and sewage in the washing tub 30 also can be discharged by means of the outlet pipe 38 for the replenishment of much clean water and meanwhile for promoting water temperature in the washing tub 30.

When cleaning process is carried on for some time, cycle washing process will be recovered. After several times of alternative processes (depending on necessary washing time preset subject to the extent of oily dirt), the dishwashing process is accomplished. At the moment the outlet pipe 38 can be withdrawn allowing residual water to be directly discharged by means of the drain pipe 50. During the cleaning process, because of the outlet pipe 38 that allows much oily water (lower specific gravity) to be discharged first and further because of the suction water pipe 32 located near the bottom of the washing tube 30 allowing to suck much clean water for use, the water therefore can comply with the requirement of cycle type cleaning process.

The invention may accomplish the following breakthroughs by means of heat cycle type cleaning process:

1. Simplifying to increase the result: the design of the invention is specifically performed for the users such as food & beverage serving area, hospital, restaurant, etc., and particularly suitable for such occasion as oily and difficult cleaning, the heat cycle type cleaning may offer the best suitability. Its result is definitely exceeding over any multi-purpose household type dishwashers.

2. Reduction in water consumption: because of the invention using cycle type water for cleaning process, water consumption is thus greatly economized.

3. Pressurized cleaning with best result: because of the invention using pressure pump for pressurizing spray and cleaning, the best cleaning result can be accomplished.

4. Low temperature difference: because of the invention using alternative washing and cleaning processes, though water temperature during washing process is slightly lowered, however water temperature can be promoted during the cleaning process to ensure that the optimal cleaning condition can be maintained throughout the washing and cleaning process.

5. Water discharged has been filtered beforehand for wastewater treatment in facility.

Besides, for strengthening cleaning result, the upper, lower spray manifolds 35, 34 and cleaning mainfolds 44 can be designed with rotary type spray bars in company with the spray angle design of nozzles to accomplish multi-angle rotary spraying result so as to provide better cleaning ability for oily dirt, residuals and food remainings.

Therefore, there has been shown and described a heat cycle type dishwasher which fulfills all the objects and advantages sought therefore. Many changes, modifications, variations and other uses and applications of the subject invention will, however, become apparent to those skilled to the art after considering the foregoing specification together with the accompanying drawings. All such changes, modifications, variations and other uses and applications which do not depart from the spirit and scope of the invention are deemed to be covered by the invention which is limited only by the claims which follow.

What is claimed is:

1. A heat cycle type dishwasher including:

a housing body wherein washing and rinsing cycles are performed, a bottom surface of the housing body resembling a rectangular tub body, a top end of the housing body having a crown plate, and four side walls formed between the crown plate and the bottom, with a first side wall being solid, and each of the other three side walls including a movable door;

a stand mounted under the housing body fort elevating the housing body and mounting other members;

a cylindrical main water reservoir mounted in a position external to the first wall of the housing body and connected to an intake pipe on a side of the reservoir, a bottom of the reservoir including a drain hole; the bottom of the reservoir further having means to receive water from the housing body, the reservoir further including near its bottom a water suction pipe;

an outlet pipe extending downward from the main reservoir, at least two filter nets, one filter net being disposed above the top of the outlet pipe, and at least one filter net being disposed between the outlet pipe and the suction pipe;

a drain pipe connected top the outlet pipe;

a cleaning tub mounted external to the housing body, a side of the cleaning tub including an intake pipe in communication with a level switch to maintain adequate water level, the cleaning tub further including near a bottom a water suction pipe;

a screw tube resembling a screw column mounted within the main water reservoir, one end of the screw tube being connected to the drain hole of the main water reservoir;

a T-joint connecting the screw tube, the intake pipe of the washing tub, and the intake pipe of the cleaning tub, which allows water to flow from the screw tube and into the washing tub and the cleaning tub;

a burner cap mounted beneath the screw tube to heat water;

a washing pump secured to the stand, with an inlet connected to the water suction pipe of the cleaning tub, and an outlet connected to a water supply pipe;

upper and lower spray manifolds connected to the water supply pipe of the washing tub, the upper and lower manifolds being mounted respectively on upper and lower ends of the housing body;

cleaning manifolds connected to the water supply pipe of the washing tub and mounted on the top end inside the housing body; wherein water in the main water reservoir, after being heated, is distributed to the washing tub and cleaning tub, with water in the washing tub being available for cycle type washing, and with water in the cleaning tub being available for rinsing, and after several alternating washing and rinsing processes, oily and dirty dishes loaded between the upper and lower manifolds are cleaned.

2. The dishwasher as claimed in claim 1 wherein:

upper and lower spray manifolds are distributed in a horizontal manner and include nozzles, the nozzles of the upper spray manifold spraying water downward, and the nozzles of the lower spray manifolds spraying water upward.

3. The dishwasher as claimed in claim 1 wherein:

cleaning manifolds are distributed horizontally above the upper spray manifolds and spray water downward.

* * * * *